US005095991A

United States Patent [19]

Milberger

[11] Patent Number: 5,095,991

[45] Date of Patent: Mar. 17, 1992

[54] DEVICE FOR INSERTING TUBULAR MEMBERS TOGETHER

[75] Inventor: Lionel J. Milberger, Houston, Tex.

[73] Assignee: Vetco Gray Inc., Houston, Tex.

[21] Appl. No.: 579,031

[22] Filed: Sep. 7, 1990

[51] Int. Cl.[5] ..... E21B 33/10

[52] U.S. Cl. ..... 166/380; 166/115; 166/242; 166/345; 166/387; 285/139; 285/345

[58] Field of Search ..... 166/345, 348, 380, 387, 166/115, 181, 242, 77.5; 285/139, 345, 346

[56] References Cited

U.S. PATENT DOCUMENTS

| | | | |
|---|---|---|---|
| 4,165,880 | 8/1979 | Olsson | 277/3 |
| 4,281,841 | 8/1981 | Kim et al. | 277/236 |
| 4,302,018 | 11/1981 | Harvey et al. | 277/27 |
| 4,817,716 | 4/1989 | Taylor et al. | 166/380 X |
| 4,869,319 | 9/1989 | Szymozak et al. | 166/115 |
| 4,872,253 | 10/1989 | Carotensen | 166/380 X |
| 4,892,149 | 1/1990 | Hoes et al. | 166/380 X |

*Primary Examiner*—Hoang C. Dang

*Attorney, Agent, or Firm*—James E. Bradley

[57] ABSTRACT

A running tool allows an upper tubular member to be inserted into a lower tubular member in a well without damage to sealing surfaces. The upper tubular member has a first side and a sealing section on a second side. A running tool with a tubular sidewall locates on the upper tubular member. Seals on the running tool engage the first side opposite the sealing section. These seals isolate a pressure area on the opposite side from the sealing section. While running into the well, hydrostatic pressure communicates with the sealing section. A pressure differential between the isolated area and the sealing section results in a radial force. The radial force deflects the sealing section radially. This allows the members to be inserted into each other with the sealing section spaced from the sealing surface of the lower tubular member. Once in place, moving the running tool upward equalizes the pressure across the sealing section. The sealing section springs into engagement with the sealing surface of the lower tubular member.

5 Claims, 2 Drawing Sheets

DEVICE FOR INSERTING TUBULAR MEMBERS TOGETHER

BACKGROUND OF THE INVENTION

1. Field of the Invention

This invention relates in general to oilfield tools for use in subsea wells, and in particular to a device for assisting in inserting an upper tubular member into a lower tubular member within a well.

2. Description of the Prior Art

There are occasions in oil well operations when an upper tubular member needs to be lowered into the well and stabbed into engagement with a lower tubular member. For example, in one type of subsea well tie-back application, a casing will be located below the water surface and within a larger diameter casing. This smaller diameter casing has an open upper end located at the wellhead at the sea floor. The operator lowers an upper string from the surface of the sea down into engagement with the upper end of the casing. This tieback operation requires some type of seals between the upper string and the lower casing.

Metal-to-metal seals are desirable in subsea wellhead applications because of the long life as opposed to elastomeric seals. Metal seals require a very tight fit. Normally, this would require that the upper tubular member have seals which interferingly engage the seals of the lower tubular member in an interference fit. Pushing the two members together can cause damage to the seals because of the interference fit.

Also, even if a good metal-to-metal seal is obtained during the first tieback operation, testing procedures may require that the upper string be disconnected from the lower string, then reconnected again. The metal sealing surfaces might be damaged by the sliding interference fit, detracting from their ability to seal on reconnection.

SUMMARY OF THE INVENTION

In this invention, a running tool is employed when engaging the upper tubular member with the lower tubular member. The running tool has a tubular sidewall. The running tool will be positioned opposite the sealing section of the upper tubular member at the surface. The sealing section of the upper string will be located on a side opposite the side engaged by the seals of the running tool. The seals of the running tool will result in a trapped or low pressure area between the seals.

When running into the well, the sealing section of the upper tubular member will be exposed to hydrostatic fluid in the well. This hydrostatic fluid will exert a large pressure force. The low pressure area between the running tool seals will be isolated from the hydrostatic pressure. The pressure differential across the upper tubular member sidewall results in a net radial force. This radial force tends to push the sealing section toward the low pressure area.

The length and thickness of the sealing section of the upper tubular member is selected so that it will deflect under this pressure differential. The deflection is enough to draw the seals out of interference contact. Preferably, a slight clearance exists as the upper tubular member engages the lower tubular member. Once in place, the running tool will be pulled upward. Pulling the running tool upward equalizes the pressure across the sealing section. With the force removed, the resiliency of the upper tubular member in the sealing section will cause the sealing section to spring into tight sealing engagement with the sealing surface of the lower tubular member.

DETAILED DESCRIPTION OF THE INVENTION

Figure 1:
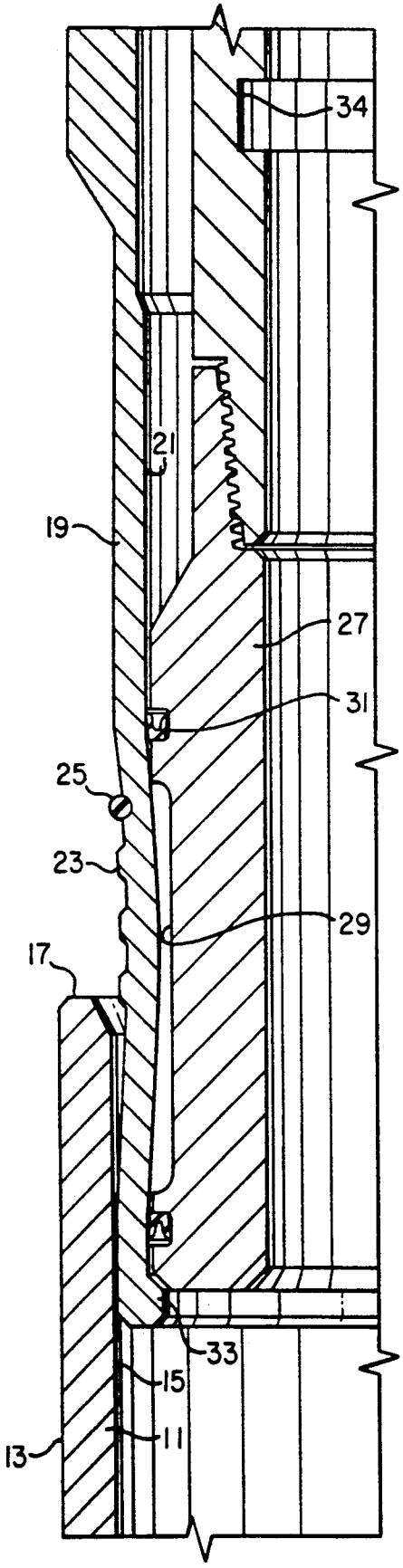
FIG. 1 is a quarter sectional view illustrating a device constructed in accordance with this invention and shown in an initial insertion position.
Figure 3:
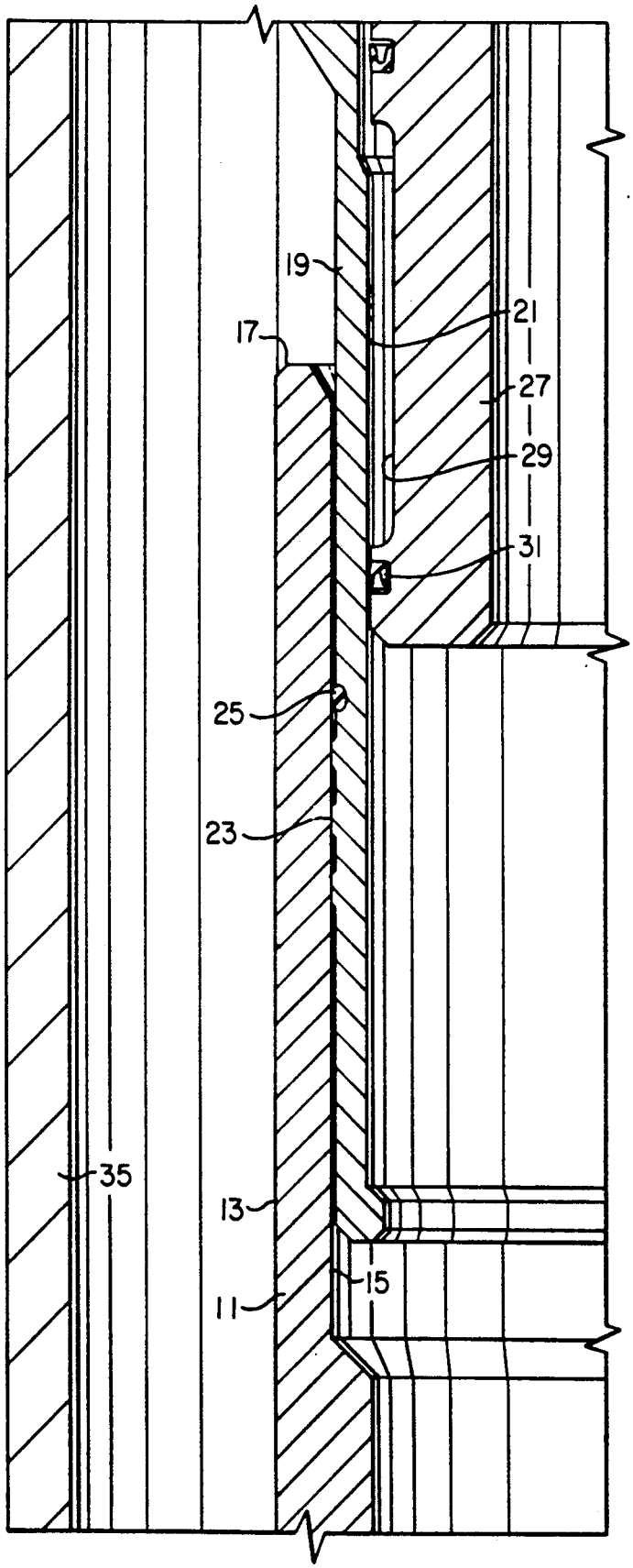
FIG. 3 is a view of the device of FIG. 1, showing the upper and lower members fully inserted within each other, and the running tool being removed.

Referring to FIG. 1, a lower tubular member 11 will be located within a well surrounded by casing 35 (shown only in FIG. 3). Lower tubular member 11 will likely be the upper end of a string of casing having an outer diameter of from seven to twelve inches. The lower tubular member 11 has an outer side 13 and a bore 15. The bore 15 and the outer side 13 are immersed in well fluid and thus exposed to hydrostatic pressure. The upper end of bore 15 is a smooth cylindrical sealing surface. Lower tubular member 11 has an open upper end 17. The upper end 17 will be located in the subsea wellhead (not shown) generally at the sea floor. Riser (not shown) extends from the wellhead to a drilling vessel or platform at the surface.

An upper tubular member 19 is shown being lowered into engagement with the lower tubular member 11. The upper tubular member 19 is the lower end of a string of casing used to form a tieback with the lower tubular member 11. The casing sections of the upper tubular member 19 will extend to a drilling platform at the sea surface.

The upper tubular member 19 has a smooth cylindrical bore 21. A sealing section locates on the outer side. The sealing section comprises metal-to-metal seals, preferably in the shape of circumferential bands 23. Sealing bands 23 have smooth cylindrical outer diameters and protrude from the outer side of the upper tubular member 19. Sealing bands 23 are axially spaced apart from each other. The sealing bands 23 have a diameter that is slightly greater than the inner diameter of the bore 15 so as to create an interference fit. This interference fit may be in the range from about ten thousandths to fifty thousandths on a side. An elastomeric seal 25 may also be used in conjunction-with the metal sealing bands 23.

The axial length from the upper sealing band 23 to the lower sealing band 23 is at least equal to the outer diameter of the upper tubular member 19. The wall thickness of the upper tubular member 19 from the bore 21 to the spaces between the sealing bands 23 is preferably from about three-eighths to one-half inch for outer diameter sizes from seven to twelve inches, respectively.

A running tool 27 is employed to assist in inserting the upper tubular member 19 into the lower tubular member 11. Running tool 27 is a tubular member. It has an annular recess 29 on its outer side, which locates in the upper tubular member bore 21 opposite the sealing bands 23. Upper and lower annular seals 31 locate above and below the recess 29. The seals 31 are axially spaced apart a distance greater than the axial extent of the metal sealing bands 23. When in the running in position shown in FIG. 1, the upper seal 31 will be spaced above the sealing bands 23 and the lower seal 31 will be spaced below the sealing bands 23.

The upper and lower seals 31 are elastomeric and have sufficient capability to seal against several thousand pounds of pressure difference. The seals 31 will serve as means for isolating the pressure in the recess 29. When installed at the surface, the pressure in the recess 29 will be atmospheric or it can be evacuated at to a vacuum condition if necessary. In the running in position, the lower end of the running tool 27 can abut against an internal shoulder 33 formed on the upper tubular member 19. A recess 34 in the interior of the running tool 27 serves as means to move the running tool 27 upward relative to the upper tubular member 19.

In operation, the operator will install the running tool 27 within the bore 21 of the upper tubular member 19, as shown in FIG. 1. Pressure in the recess 29 will be at atmospheric. The lower end of the running tool 27 will abut the shoulder 33. The upper end (not shown) of the running tool 27 will be located a short distance above the sealing bands 23. The recess 29 will be opposite the sealing bands 23.

The operator will then lower the sections of the upper tubular member 19 into the riser (not shown) leading downward to the subsea wellhead. While being lowered in the riser, the running tool 27 will remain in its lower position located within the bore 21 of the upper tubular member 19. As the upper tubular member 19 descends into the riser, hydrostatic pressure will increase. The bore 21 of the upper tubular member 19 is exposed to well fluid. This hydrostatic fluid will act on the sealing bands 23. The seals 31, however, isolate the recess 29 from this hydrostatic pressure. Consequently, a pressure differential between the hydrostatic pressure and the atmospheric pressure in recess 29 will gradually build up. This results in a radially directed inward force on the seal bands 23.

Figure 2:
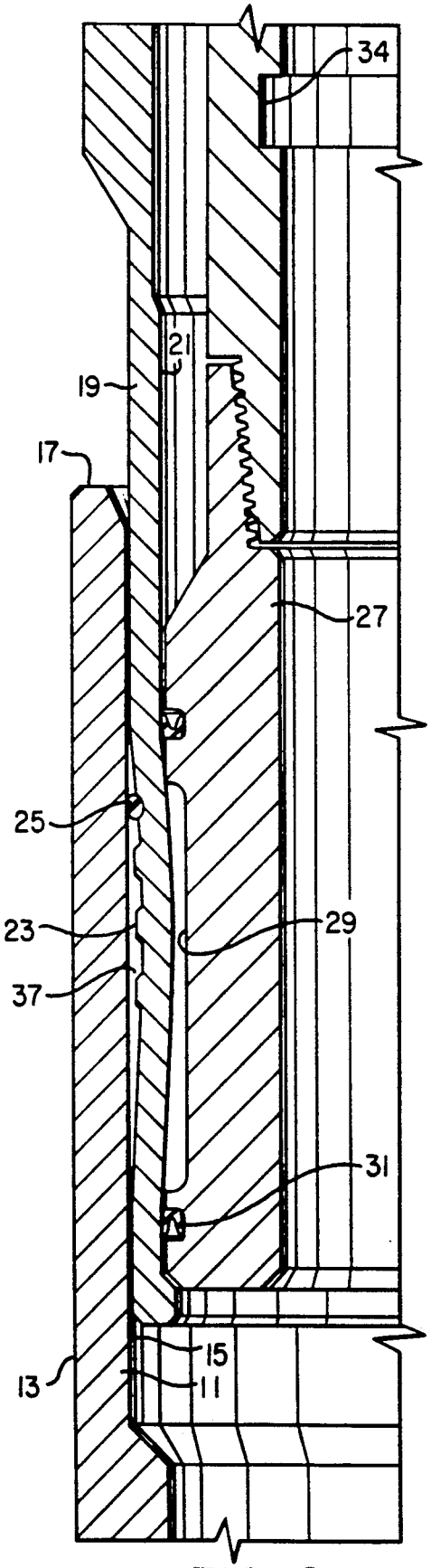
FIG. 2 is a quarter sectional view of the device of FIG. 1, showing the upper and lower members fully inserted within each other.

The axial length and wall thickness of the sealing section at seal bands 23 is selected, considering the expected hydrostatic pressure, so that it will begin to deflect at least by the time the upper tubular member 19 reaches the lower tubular member 11. The deflection 37, shown exaggerated in FIG. 2, is preferably enough to allow a clearance of the sealing bands 23 as the upper tubular member 19 slides into the lower tubular member 11. The deflection 37 in the upper tubular member 19 draws the sealing bands 23 radially inward. The recess 29 accommodates this inward movement. The deflection is within the elastic range of the steel material of the upper tubular member 19 so as to avoid permanent deformation.

Once fully inserted, the lower tubular member 19 will appear as shown in FIG. 2. The pressure differential across the sealing bands 23 will keep the sealing bands 23 out of contact with the bore 15. The operator then will energize the seal by moving the running tool 27 upward, as shown in FIG. 3. This can be handled in various ways. In one way, a retrieving tool (not shown) of conventional nature will be lowered through the bore 21 of the upper tubular member string 19. The retrieving tool will engage the recess 34 in a conventional manner. The operator will then pull the running tool 27 upward. Once the running tool 27 moves above the sealing bands 23, pressure across the upper tubular member 19 at the sealing bands 23 will equalize on both sides. The resiliency of the upper tubular member 19 at the sealing bands 23 causes the sealing bands 23 to spring back outward to its natural position. The cylindrical outer diameters of the sealing bands 23 will contact the bore 15 in tight sealing engagement.

If testing requires that the upper tubular member 19 be subsequently disconnected and reconnected, then the running tool 27 may remain within the bore 21 a short distance above the sealing bands 23. The process of deflecting the sealing bands 23 radially inward can be repeated by lowering the running tool 27 again against the shoulder 33. Once testing has been completed, the operator will pull the retrieving tool to the surface, bringing along with it the running tool 27.

The invention has significant advantages. The device preserves the metal seals and sealing surfaces in a case where tubular members are inserted into each other downhole. The device draws the sealing section back from the sealing surfaces a sufficient amount to avoid damage during insertion.

While the invention has been shown in only one of its forms, it should be apparent to those skilled in the art that it is not so limited, but is susceptible to various changes without departing from the scope of the invention. For example, rather than the upper tubular member inserting into a lower tubular member, the upper tubular member could slide over the upper tubular member.

I claim:

1. In a well, a lower tubular member with a sealing surface located in the well, an upper tubular member which inserts into engagement with the lower tubular member during running in, the upper and lower tubular members being exposed to well fluid pressure, an improved means for sliding the upper tubular member into engagement with the lower tubular member, comprising in combination:

the upper tubular member having a first side and a second side, the second side having a sealing section which mates with the sealing surface of the lower tubular member;

a running tool having a tubular sidewall;

axially spaced apart seal means located on the running tool sidewall for sealingly engaging the first side of the upper tubular member above and below the sealing section during running in, for defining a low pressure area between the running tool and the first side which is isolated from the well fluid pressure;

the sealing section of the upper tubular member being exposed to well fluid pressure during running in, resulting in a pressure difference across the upper tubular member between the first side of the tubular member and the sealing section, the thickness of the upper tubular member between the first side and the sealing section being selected to be sufficiently thin so as to allow the sealing section to resiliently deflect radially toward the low pressure area due to the pressure difference, to reduce sliding contact of the sealing section with the sealing surface as the upper tubular member slides into engagement with the lower tubular member; and means for eliminating the pressure difference across the upper tubular member between the first side and the sealing section after the upper tubular member has reached its engaged position with the lower tubular member, allowing the sealing section to move radially into engagement with the sealing surface.

2. In a well, a lower tubular member having a sealing surface located in the well, an upper tubular member which inserts into engagement with the lower tubular member, the upper and lower tubular members being exposed to well fluid presssure in the well, an improved means for sliding the upper tubular member into engagement with the lower tubular member during running in, comprising in combination:

the upper tubular member having a first side and a second side, the second side having a sealing section which mates with the sealing surface of the lower tubular member;

a running tool having a tubular sidewall;

a pair of axially spaced apart annular seals located on the running tool sidewall for sealingly engaging the first side of the upper tubular member above and below the sealing section during running in;

the running tool sidewall and the first side of the upper tubular member having an annular recess between them during running in, the seals of the running tool being located above and below the recess during running in;

the seals of the running tool defining a low pressure area in the recess between the running tool and the first side of the upper tubular member which is isolated from the hyrdostatic pressure of the well;

the sealing section of the upper tubular member being exposed to well fluid pressure during running in, resulting in a pressure difference across the upper tubular member between the low pressure area and the well fluid pressure, the thickness of the upper tubular member between the first side and the sealing section being selected to be sufficiently thin so as to allow the sealing section to resiliently deflect radially toward the low pressure area due to the pressure difference, to reduce sliding contact of the sealing section with the sealing surface as the upper tubular member slides into engagement with the lower tubular member; and the running tool seals being movable upward relative to the upper tubular member after the upper tubular member has reached its engaged position with the lower tubular member, to equalize the pressure between the upper tubular member first side and sealing section, allowing the sealing section to move radially into engagement with the sealing surface.

3. In a well, a lower tubular member located in the well with an upper open end and a sealing surface, an upper tubular member which inserts into engagement with the lower tubular member, the lower tubular member and the upper tubular member being exposed to well fluid pressure, an improved means for sliding the upper tubular member into engagement with the lower tubular member during running in, comprising in combination:

the upper tubular member having a first side and an second side, the second side having a sealing section with axially spaced apart metal sealing bands which mate with the sealing surface of the lower tubular member, each of the sealing bands having a diameter prior to insertion that has an interference fit with the sealing surface;

a running tool having a tubular sidewall;

a pair of annular seals located on the sidewall of the running tool and spaced apart a selected distance for sealingly engaging the first side of the upper tubular member above and below the sealing section during running in;

the running tool sidewall having an annular recess located between the seals;

the seals of the running tool defining a low pressure area in the recess between the running tool and the first side which is isolated from the fluid pressure of the well;

the sealing section of the upper tubular member being exposed to well fluid pressure during running in, resulting in a pressure difference across the upper tubular member between the low pressure area and the well fluid pressure, the thickness of the upper tubular member between the first side and the sealing section being selected to be sufficiently thin so as to allow the sealing section to resiliently deflect radially into the recess due to the pressure difference enough to remove the intereference fit of the sealing section with the sealing surface as the upper tubular member slides into engagement with the lower tubular member; and means for moving the running tool seals upward relative to the upper tubular member after the upper tubular member has reached its engaged position with the lower tubular member, to equalize the pressure between the upper tubular member first side and sealing section, allowing the sealing section to move radially into engagement with the sealing surface.

4. A method for sliding an upper tubular member into engagement with a sealing surface of a lower tubular member in a well having well fluid pressure, comprising in combination:

providing the upper tubular member with a first side and a second side and providing the second side with a sealing section for mating with the sealing surface of the lower tubular member:

providing a running tool with a tubular sidewall;

sealingly engaging the first side of the upper tubular member above and below the sealing section with the running tool to define a low pressure area;

lowering the running tool and upper tubular member into the well;

exposing the sealing section to well fluid pressure and isolating the low pressure area from well fluid pressure to provide a pressure differential between the low pressure area and the well fluid pressure;

resiliently deflecting the sealing section radially toward the low pressure area due to the pressure differential, to reduce sliding contact of the sealing section with the sealing surface as the upper tubular member slides into engagement with the lower tubular member; then equalizing the pressure between the upper tubular member first side and sealing section, and allowing the sealing section to move radially into engagement with the sealing surface.

5. A method for sliding an upper tubular member into engagement with a sealing surface of a lower tubular member in a well having well fluid pressure, comprising in combination:

providing the upper tubular member with a first side and a second side and providing the second side with a sealing section for mating with the sealing surface of the lower tubular member:

providing a running tool with a tubular sidewall;

sealingly engaging the first side of the upper tubular member above and below the sealing section with the running tool to define a low pressure area;

lowering the running tool and upper tubular member into the well;

exposing the sealing section to well fluid pressure and isolating the low pressure area from well fluid pressure to provide a pressure differential between the low pressure area and the well fluid pressure;

resiliently deflecting the sealing section radially toward the low pressure area due to the pressure differential, to reduce sliding contact of the sealing section with the sealing surface as the upper tubular member slides into engagement with the lower tubular member; and moving the running tool seals upward relative to the upper tubular member after the upper tubular member has reached its engaged position with the lower tubular member, equalizing the pressure between the upper tubular member first side and sealing section, and allowing the sealing section to move radially into engagement with the sealing surface.

* * * * *